United States Patent [19]

Mochizuki et al.

[11] Patent Number: 4,880,389

[45] Date of Patent: Nov. 14, 1989

[54] IGNITION PLUG CONNECTOR AND MANUFACTURING METHOD

[75] Inventors: Shigehiko Mochizuki, Susono; Masahiro Kanda; Yoshinori Serizawa, both of Gotenba, all of Japan

[73] Assignee: Yazaki Corporation, Tokyo, Japan

[21] Appl. No.: 643,236

[22] Filed: Aug. 22, 1984

[30] Foreign Application Priority Data

Aug. 23, 1983 [JP] Japan ..... 58-152419

[51] Int. Cl.[4] ..... H01R 13/573

[52] U.S. Cl. ..... 439/125; 29/858; 439/865

[58] Field of Search ..... 339/223 S, 218 R, 17, 339/5; 29/858; 439/865, 868, 125

[56] References Cited

U.S. PATENT DOCUMENTS

| | | | |
|---|---|---|---|
| 2,745,075 | 5/1956 | Simpkins et al. | 339/218 S X |
| 3,184,701 | 5/1965 | Ellis | 339/218 M X |
| 3,212,044 | 10/1965 | Cloud | 339/223 S X |
| 3,266,008 | 8/1966 | Elliott | 339/223 S |
| 3,404,368 | 10/1968 | Roberts et al. | 339/223 S |

FOREIGN PATENT DOCUMENTS

| | | | |
|---|---|---|---|
| 47-41713 | 10/1972 | Japan | 339/223 S |
| 48-25283 | 3/1973 | Japan . | |
| 55-97175 | 12/1980 | Japan . | |

*Primary Examiner*—Eugene F. Desmond

*Attorney, Agent, or Firm*—Foley & Lardner, Schwartz, Jeffery, Schwaab, Mach, Blumenthal & Evans

[57] ABSTRACT

An ignition plug connector and the method for manufacturing the connector, in which a metallic terminal is provided to receive one end portion of a high tension cord and securely hold the end portion by crimping, and the metallic terminal and the end portion of the high tension cord are covered by an insulating rubber cap formed through molding.

In addition, the exposed conducting member extending from the end portion of the cord contacts with the inner surface of the metallic terminal, over which part of the rubber cap is provided to form a wall integral with the rubber cap so as to eliminate air gaps from near the exposed conducting member.

6 Claims, 3 Drawing Sheets

IGNITION PLUG CONNECTOR AND MANUFACTURING METHOD

BACKGROUND OF THE INVENTION

1. Field of the Invention

The present invention relates to a connector of a high tension cable or cord for an ignition plug used in an ignition circuit and the method of manufacturing the same, more specifically to a connector for use with the ignition plug made by connecting one end of the high tension cord to one end section of a metal terminal and covering the end of the cord and the metal terminal with an insulating rubber cap through molding, thereby forming the connector.

2. Description of the Prior Art

A conventional connector for connecting a high tension cable or cord containing a conducting member to an ignition plug is generally described hereinafter. A connector comprises a metallic terminal and an insulating rubber cap. The high tension cable or cord is inserted at one end portion thereof into the connector with the insulating coating of the end portion of the high tension cord stripped to expose the end portion of the conducting member contained in the high tension cord. The exposed conducting member portion is folded over the surface of the cord coating or cover so as to come into contact with the inner surface of the metallic terminal when inserted therein. That portion of the metallic terminal is crimped to fixedly hold the end portion of the high tension cable or cord received therein. The other end of the metallic terminal forms a plug receiving portion for receiving the ignition plug. The cord end portion and metallic terminal are covered with an insulating rubber cap. The portion where the rubber cap and the high tension cord are joined is properly coated with an adhesive. Depending on circumstance, the exposed conducting member at the end portion of the high tension cord may be covered with a covering layer formed from an insulating or conducting material before the insulating rubber cap is provided.

In the conventional connector wherein the metallic terminal is inserted into the independently formed rubber cap with the joined portion between the high tension cord and the rubber cap coated with an adhesive after insertion, the adherence of the cord to the rubber cap depends mainly on the bonding strength of the adhesive, which causes some problems in the connector as follows:

(1) A slight pull will result in the connector being pulled out.

(2) As a result of the permanent compression strain of the rubber cap and the action of removing it from the ignition plug, the bonded sections are inclined to be separated, and disengagement of the cord and leakage easily occur.

(3) As a result of the action of inserting and removing the ignition plug, displacement readily occurs between the rubber cap and the high tension cable or cord. (4) In the exposed section of the conducting member, where it is not covered with an insulating or conducting material, an electrical discharge can occur from the exposed section of the conducting member to the metallic terminal, and the increase in temperature at the end portion of the cord reaches 120° C. to 200° C., so that the cord will be easily damaged by heat.

(5) Even in the case where the exposed section of the conducting member is covered with an insulating or conducting member, an air pocket can be easily created between the cover and the conducting member, and there is the problem of fire damage to the conducting member from an internal corona discharge.

As a means to eliminate this kind of problems, if a cap is formed directly around the metallic terminal and the high tension cord through molding rather than using an adhesive to mount a cap thereto, it is possible to markedly increase the bonding strength. However, in molding, in the case where a rubber material such as EPDM having high viscosity usually used in this field is utilized, it is necessary to use extremely high pressure during molding, so there is the danger that the metallic terminal and the cord will be damaged. In the case where a thermoplastic resin is used, the high tension cord, especially, is degraded by heat because the molding is carried out at extremely high temperatures. In the case where a thermosetting resin is used, it does not perform adequately as a cap because it becomes extremely hard after molding. For reasons such as these, the molding of a cap around the metallic terminal and high tension cord has not usually been carried out.

SUMMARY OF THE INVENTION

The object of the present invention is to provide a high performance ignition plug connector with long endurance and the method of manufacturing it through the use of an addition reaction type silicon rubber with low viscosity and bridging cross-linking property for the cap molding, and a wall or portion integral with the cap is provided to cover the exposed conducting member, which will avoid the above-mentioned problems

BRIEF DESCRIPTION OF THE DRAWINGS

These and other objects, features, and advantages of the present invention will be more apparent from the following description of a preferred embodiment, taken in conjunction with the accompanying drawings, in which.

DESCRIPTION OF THE PREFERRED EMBODIMENTS

Figure 1:
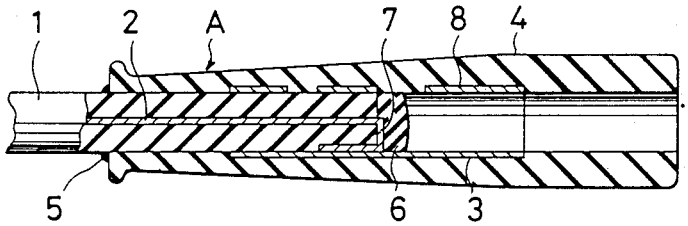
FIG. 1 PRIOR ART
FIG. 1 is a cross-sectional view showing a conventional connector for an ignition plug.

Now referring to the drawing, a conventional connector generally designated by A for connecting a high tension cable or cord 1 containing a conducting member 2 to an ignition plug is shown on FIG. 1. The connector comprises a metallic terminal 3 and an insulating rubber cap 4. The high tension cable or cord 1 is inserted at one end portion thereof into the connector with the insulating coating of the end portion of the high tension cord 1 stripped to expose the end portion 7 of the conducting member 2 contained in the high tension cord 1. The exposed conducting member is folded over the outer surface of the cord coating so as to come into contact with the inner surface of the metallic terminal 3 when the end portion of the high tension cord is inserted into the metallic terminal 3. The section of the metallic terminal 3 having received the end portion of the high tension cord 1 is crimped to fixedly hold the cord end portion. The other end of the metallic terminal forms a typically cylindrical, plug receiving portion 8 for receiving the ignition plug.

The cord end portion and the metallic terminal are covered with an insulating rubber cap 4 which is independently produced, and the portion 5 where the rubber cap and the high tension cord are joined is properly coated with an adhesive. Further, the exposed conducting member at the end portion of the high tension cord may be covered with a layer 6 formed from an insulating or conducting material.

Figure 2:
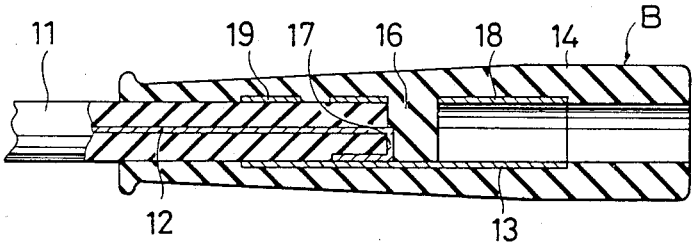
FIG. 2 is a cross-sectional view showing a connector for an ignition plug according to the present invention.
Figure 3:
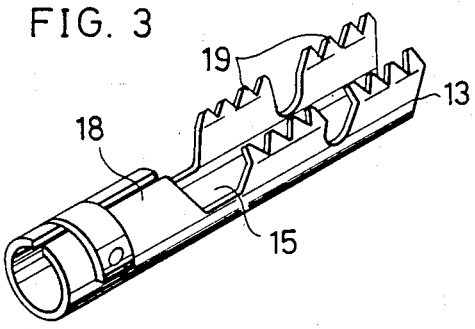
FIG. 3 is a perspective view showing the metallic terminal used for the connector of FIG. 2.
Figure 4:
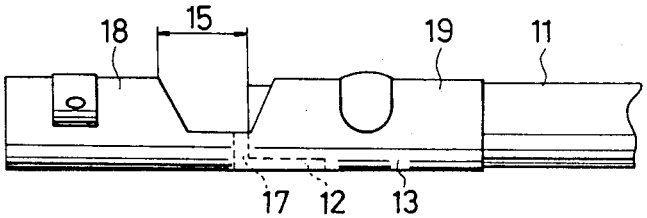
FIG. 4 is a front elevational view showing the connector for the ignition plug of FIG. 2 before being covered by the rubber cap.

The following is now a detailed explanation of the present invention with reference to FIG. 2, FIG. 3, and FIG. 4. An insulating cover at the end of a high tension cord 11 is stripped, and a conducting member is exposed, and the conducting member 12 is folded over the outer surface of the cover or coating of the cord 11. The folded end of the conducting member 12 contacts with the inner surface of a metallic terminal 13 when inserted into the metallic terminal 13, and that section, of the metallic terminal 13 is crimped with the end portion of the high tension cord 11 therein.

One embodiment of the metallic terminal 13 is shown in FIG. 3. This metallic terminal 13 has a cylindrical, plug receiving section 18 at one end thereof for insertion of the ignition plug, and a crimpable section or cord connecting section 19 at the other end thereof, and is provided with a cut-out or open section 15 between the plug receiving section 18 and the crimpable sections 19 which is explained in detail hereinafter. As can be seen from FIG. 3, the edges of crimpable sections 19 are notched to provide interengaging indentations when the crimpable sections are crimped.

As shown in FIG. 4, the end portion of the high tension cord 11 is exposed, and the conducting member 12 is folded over the outer surface of the cord 11 so as to come into contact with the metallic terminal 13 when inserted therein, and the crimpable section 19 is crimped with the cord 11 contacted therein as mentioned above. At this time, it is desirable to place the contacting portion of the exposed conducting member 17 at the bottom of the metallic terminal 13, that is, at a position opposite to the open section 15. However, the contacting portion of the exposed conducting member 17 can be placed at another inner surface of the metallic terminal 13.

Next, at least the outer surface of the end portion of the high tension cord 11 is coated with a silicone-based primer, which forms a hard, thin film of silicone resin. The coating is sufficiently effective even when the primer is applied only to the peripheral surface of the high tension cord, although the silicone-based primer can be coated on the surface of the metal for silicone rubber bonding.

Next, as is shown in FIG. 2, the end portion of the cord 11, and the metallic terminal 13 are covered by a cap 14 having a hole for receiving the ignition plug, and, in this embodiment of the present invention, the cap 14 is made from an addition reaction type liquid silicone rubber of a viscosity of 10 to 50,000 poise through molding, and thus a connector B is obtained. In addition, as shown in the drawing, the cap 14 can be extended to form an extension of the plug receiving section 18 for insertion of the ignition plug.

It will be also noted that the wall section 16 formed integrally with the rubber cap 14 and extending through the cut-out or open space 15 in the center section of the metallic terminal 13 completely covers the periphery of the exposed section 17 of the conducting member. This wall will prevent the rubber cap from readily pulling out, and electrical discharge from the exposed conducting member 17 to the plug receiving portion 18 is prevented. In addition, there are no air gaps between the conducting member 12 and the molded material 14, so that internal corona discharge can be prevented, and the degradation by oxidation of the conducting member 12 can be restrained.

Figure 5:
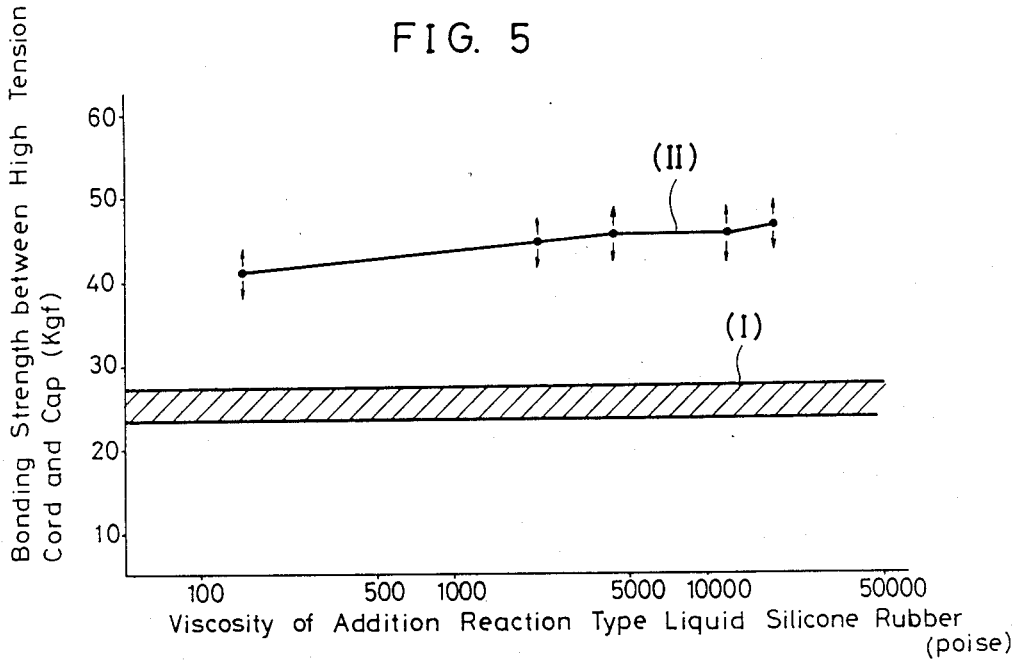
FIG. 5 is a graph showing test results of the strength of the joint between the high tension cord and the rubber cap in a connector according to the present invention.

FIG. 5 shows the relationship between the viscosity of the addition reaction type liquid silicone rubber forming the cap 14 and the bonding strength between the high tension cord 11 and the cap 14. It will be noted that the level of bonding strength (II) of the integrally molded connector is at least 5 kgf higher than that(I) of the conventional product at each viscosity of 150, 2,150, 4,460, 12,100, and 19,600 poise, and that the level of bonding strength increases as the viscosity increases in the liquid silicone rubber. Consequently, the end portion of the high tension cord has enough strength to prevent failure during normal use.

Figure 7:
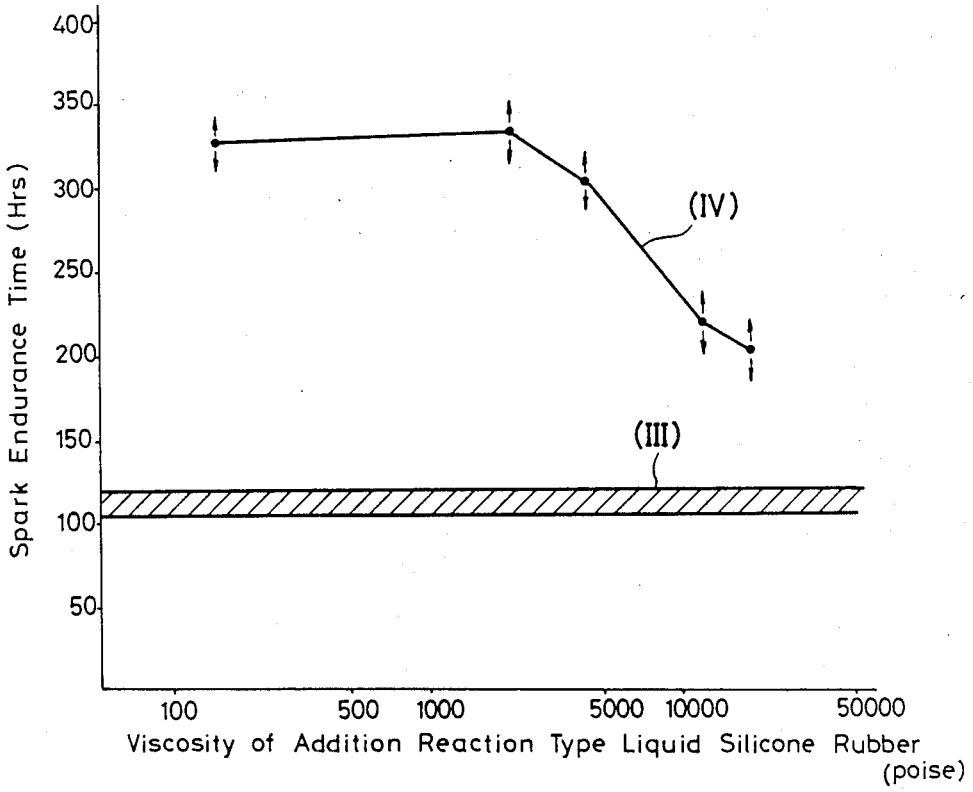
FIG. 7 is a graph showing the test results of a spark endurance test for a connector according to the present invention.
Figure 6:
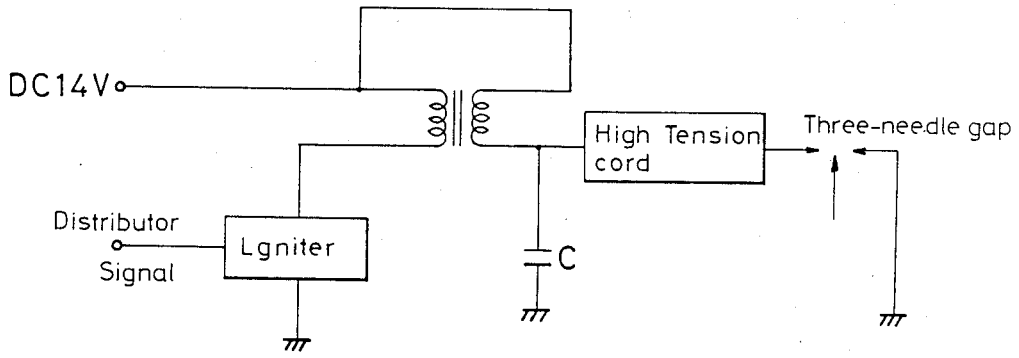
FIG. 6 is a spark endurance test circuit diagram for the end portion of the high tension cord.

The test circuit of FIG. 6 is used for investigating the spark endurance time of a connector according to the present invention. In the same way as in the above-mentioned bond strength tests in FIG. 5, FIG. 7 gives the relationship between the viscosity and the spark endurance time. In the abovementioned test circuit, voltages at 100 Hz and 20 Kvp are applied to the end portion of the high tension cord or cable, and the time is measured for the resistance value of the high tension cord to exceed 200% of its initial value. As shown in FIG. 7, when compared with the endurance level (III) of conventional products, that (IV) of the connector according to the present invention, can be seen to give greater than 100 hours improvement in spark endurance. It will be also noted that the spark endurance time, when the viscosity of the addition reaction type liquid silicone rubber is less than 2500 poise, exhibits about 200 hours improvement, and, at a viscosity greater than 2500 poise, because of the distortion of the conducting member at the end portion of the high tension cord at formation, the spark endurance time is seen to gradually decrease.

The advantages of the present invention are summarized as follows;

(1) The metallic terminal is prevented from being pulled from the high tension cord.

(2) There is close adhesion between the rubber cap and the high tension cord, making it difficult to peel them apart, and therefore disengagement and leak are not produced.

(3) No displacement is produced between the rubber cap and the high tension cord.

(4) Discharge of electricity from the conducting member to the metallic terminal is prevented. In addition, internal corona discharge is prevented, and the reliability of the end portion of the high tension terminal is increased, and stable energy transmission can be carried out.

(5) The time used for maintenance inspection of the high tension cord can be saved.

Figure 8:
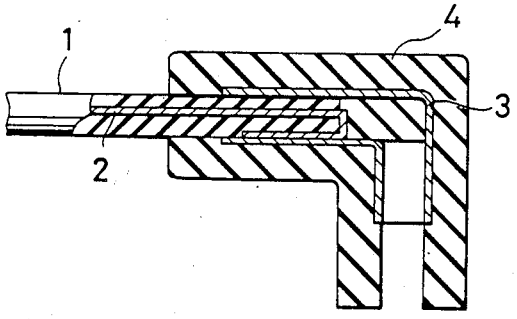
FIG. 8 is a cross sectional view showing a L-shaped connector for an ignition plug according to the present invention.
Figure 9:
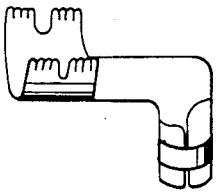
FIG. 9 is a perspective view showing the metallic terminal used for the connector of FIG. 8.
Figure 10:
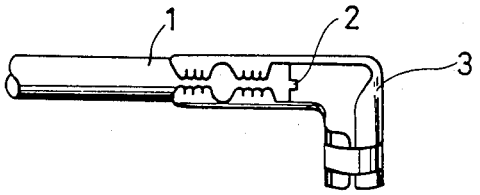
FIG. 10 is a plan view showing the connector of FIG. 8 before being covered by the rubber cap.

The present invention is not restricted to the above-mentioned straight-type metallic terminal, and a high performance ignition plug connector can be obtained by a L-shaped metallic terminal as shown in FIGS. 8 to 10. This terminal has a plug receiving section and a crimpable section or cord connecting section directed substantially at an angle of 90 degrees to the plug receiving section with a cut-out or open section therebetween, for which further explanation is unnecessary.

Various modifications will become possible for those skilled in the art after receiving the teachings of the present disclosure without departing from the scope thereof.

What is claimed is:

1. An ignition plug connector comprising a metallic terminal having at one end thereof a plug receiving section for insertion of an ignition plug, at the other end thereof a cord connecting section for receiving one end portion of a high tension cord and crimped after the end portion is inserted, and, having a cut-out in the center section between said plug receiving portion and said high tension cord connecting section, a thin covering layer of silicone resin primer covering at least said end portion of said high tension cord; and a rubber cap which is formed through molding an addition reaction type silicone rubber having a viscosity from 10 to 50,000 poise to generally cover said metallic terminal and said end portion of said high tension cord; wherein said plug receiving section of said metallic terminal and said rubber cap portion axially adjacent to said plug receiving section form a hole for the ignition plug; the exposed conducting member extending from said end portion of said high tension cord contacts the inner surface of said metallic terminal; and a wall section is integrally formed with said rubber cap through said cut-out between said plug receiving section and said cord connecting portion to completely contact said exposed conducting member of the end portion of said cord and thereby eliminate air gaps in the vicinity of said exposed conducting member.

2. The ignition plug connector of claim 1, wherein said rubber cap is made of an addition reaction type silicone rubber of a viscosity from 100 to 20,000 poise.

3. The ignition plug connector of claim 1, wherein said rubber cap section axially adjacent to said plug receiving section of the said metallic terminal has a comparatively long extended section.

4. The ignition plug connector of claim 1, wherein said metallic terminal is L-shaped, and said high tension cord connecting section is substantially at an angle of 90 degrees to said cylindrical section.

5. A manufacturing method for an ignition plug connector in which a metallic terminal is connected to one end portion of a high tension cord, and said end portion of the high tension cord and said metallic terminal are covered by an insulating rubber cap, said method comprising the steps of:

(1) providing a metallic terminal having at one end thereof a plug receiving section for insertion of the ignition plug, and at the other end thereof a cord connection section which is adapted to be crimped, and a central section having a cut-out between said plug receiving section and said cord connection section;

(2) inserting said end portion of said high tension cord into said cord connection section of said metallic terminal such that an exposed conducting member extending from said end portion of said high tension cord comes into contact with the inner surface of said metallic terminal;

(3) crimping said cord connection section of said metallic terminal into which said end portion of said cord is inserted whereby said end portion of the cord is secured to said cord connection section of said metallic terminal;

(4) providing a thin covering layer of silicone resin primer at least over the end portion of said cord which is to be covered by said insulating rubber cap;

(5) forming a rubber cap through molding an addition reaction type silicone rubber having a viscosity from 10 to 50,000 poise to generally cover said end portion of said cord and said metallic terminal, wherein said plug receiving section and the cap portion axially adjacent to said plug receiving section define a hole for the ignition plug and wherein part of said rubber cap extends through said cut-out to form a wall section covering said exposed conducting member extending from said end portion of said high tension cord into contact with the inner surface of said metallic terminal so as to eliminate air gaps in the vicinity of said exposed conducting member.

6. The method of claim 1, wherein said rubber cap is made of an addition reaction type silicone rubber having a viscosity from 100 to 20,000 poise.

* * * * *